US005518675A

United States Patent [19]

Sims

[11] Patent Number: 5,518,675

[45] Date of Patent: May 21, 1996

[54] METHOD FOR INTERMIXING COMMINUTED DRIED MATERIALS

[75] Inventor: Kenneth M. Sims, Irving, Tex.

[73] Assignee: York Chemical Corporation, Irving, Tex.

[21] Appl. No.: 400,670

[22] Filed: Mar. 8, 1995

Related U.S. Application Data

[63] Continuation of Ser. No. 63,161, May 12, 1993, abandoned.

[51] Int. Cl.[6] ..... B01F 15/02; B29C 43/02

[52] U.S. Cl. ..... 264/122; 264/109; 366/156.1

[58] Field of Search ..... 264/109, 122; 366/134, 133, 156.1, 158.4

[56] References Cited

U.S. PATENT DOCUMENTS

| | | | |
|---|---|---|---|
| 922,863 | 5/1909 | Dor-Delattre | 366/133 |
| 1,558,580 | 10/1925 | Bishop | 366/133 |
| 2,340,673 | 2/1944 | Lotz et al. | 425/145 |
| 2,741,796 | 4/1956 | King | 222/367 |
| 3,090,992 | 5/1963 | Schlachter et al. | 425/145 |
| 3,194,538 | 7/1965 | Murray | 366/133 |
| 3,483,594 | 12/1969 | Hewitt | 425/145 |
| 3,671,633 | 6/1972 | Sheth et al. | 264/122 |
| 3,753,676 | 8/1973 | Halley . | |
| 4,136,967 | 1/1979 | Grigat et al. | 366/134 |
| 4,151,932 | 5/1979 | Wachtler | 222/77 |
| 4,192,763 | 3/1980 | Buchan | 252/187 H |
| 4,265,847 | 5/1981 | Hunt et al. | 264/122 |
| 4,349,542 | 9/1982 | Staniforth | 264/122 |
| 4,405,486 | 9/1983 | Eoga | 264/122 |
| 4,424,016 | 1/1984 | Matsuda et al. | 425/145 |
| 4,443,109 | 4/1984 | Watts | 366/134 |
| 4,492,478 | 1/1985 | Ito et al. | 366/134 |
| 4,560,766 | 12/1985 | Girard et al. | 264/122 |
| 4,561,781 | 12/1985 | Seymour | 366/134 |
| 4,710,032 | 12/1987 | Nordlund | 366/134 |
| 4,884,724 | 12/1989 | Schmidt | 222/623 |
| 4,890,996 | 1/1990 | Shimizu | 425/145 |
| 5,018,868 | 5/1991 | Baillie | 366/134 |
| 5,106,559 | 4/1992 | Wiedrich et al. | 264/122 |
| 5,114,647 | 5/1992 | Levesque et al. | 264/122 |

*Primary Examiner*—Allan R. Kuhns
*Attorney, Agent, or Firm*—Arthur J. Plantamura

[57] ABSTRACT

A method and apparatus is provided for intimately intermixing a first finely divided dry material into a second finely divided dry material to produce a dry blend of the two materials. In a specific application, the method and apparatus provide an improved means for introducing an homogeneously distributing a dry powdered lubricant into a dry powdered material (such as chlorine) which is to be shaped into a molded article. The means for forcibly introducing the powdered additive into the powdered material which is to be molded into a tablet form may comprise a mechanical device such as a screw type conveyer, e.g., an auger or other suitable mechanical means or it may comprise a pneumatic device which propels the powdered additive into the body of the dried, finely divided material to produce a dry blend.

8 Claims, 4 Drawing Sheets

METHOD FOR INTERMIXING COMMINUTED DRIED MATERIALS

This application is a continuation of application Ser. No. 08/063,161, filed on May 12, 1993, now abandoned.

This invention relates to an improved method and apparatus for expeditiously mixing a plurality of comminuted dried material to form a homogeneously dry blend. More specifically the invention relates to an improved system for introducing and blending in the dry form a relatively small quantity of a second finely divided dry material into a mass of a first relatively finely divided dry material.

BACKGROUND OF THE INVENTION

The difficulty of homogeneously mixing a comminuted dried material into a mass of another comminuted dried material, especially when it is necessary to process large quantities of dry materials is time consuming and cumbersome. An operation of this kind is usually performed manually by a batch process and is tedious. The mixing must normally be scheduled well in advance to be ready for use when needed and frequently results in delaying an operation that would otherwise be a relatively expeditious procedure if a capability were available to perform the blending in a continuous manner. One situation of this kind, for example, involves the introduction of a powdered lubricant into the body of a mass of material that is to fed to and shaped in a mold or press. One particular operation of this kind involves adding a lubricant to a powdered or granulated chlorine chemical which is to be formed into tablets in a tablet forming press. In the tablet forming press, unless the lubricant is substantially uniformly mixed with the material to be formed in the mold press, the sticking of the material to the mold may result in an imperfect shape and often results in a serious interruption in the tablet forming production.

While efforts have been made in certain tablet forming or other molding operation to introduce a liquid lubricant into the shaping press, such as by the means disclosed in U.S. Pat. No. 3,483,594, this approach is limited in applicability to materials that can be processed by this means and is not suitable, and in some cases cannot be tolerated, in other environments. For example, in the manufacture of chlorine containing tablets obtained by forming the tablets in a mold or press, the use of a liquid lubricant is entirely unsuitable. The system as a practical matter must be maintained dry. It is necessary that a solid lubricant be blended into the dry chlorine powder which is to be shaped into tablets. This blending in of the solid lubricant, as a practical matter, has been heretofore carried out by the hand addition of the dry lubricant to the chlorine powder at a considerable cost in time and manpower. The need for a practical and efficient alternative to such manual intermixing of two finely divided solids is apparent.

SUMMARY OF THE INVENTION

The present invention contemplates a novel process and apparatus for carrying out a procedure of efficiently introducing a first finely divided solid dry material into a mass of a second finely divided dry material to yield a dry blended mixture.

It is a more specific object of the invention to provide an improved method for continuously intermixing a finely divide dry lubricant into a finely divided material which is to be formed under pressure into tablets, or other molded shape in a forming press.

A further object of the invention resides in the provision of a means for the introduction and homogeneous distribution of a dry additive within a mass of a body of finely divided dry material while maintaining the the material and the additive in the dry state.

Another object of the invention involves the provision an auger feed means for introducing a finely divided dry lubricant into a dry comminuted mass which is to be shaped into a predetermined form, such as a tablet, in a pressure mold.

Still another object of the invention resides in the introduction, by pneumatic injection into a dry mass of a finely divided material that is to be shaped in a mold, of a dry finely divided lubricant, also in the dry state, to provide a suitable molding blend.

Various additional objects and advantages will become apparent from the description of the invention that is described in conjunction with the accompanying drawing.

DETAILED DESCRIPTION OF THE PREFERRED EMBODIMENTS

The invention described in detail hereinbelow will be considered in conjunction with a specific application, namely, in connection with its use to introduce a finely divided dry lubricant into a mass of a finely divided dry chlorine composition that is to be shaped in a mold press into a marketable tablet or briquette form. The resulting shaped product, among its end uses, is conventionally employed in the treatment of swimming pool water. It will be understood, however, that the invention is not to be limited to the intermixing of these two materials and that the invention may find application to facilitate the intermixing of two or more of various other finely divided dry materials.

Figure 1:
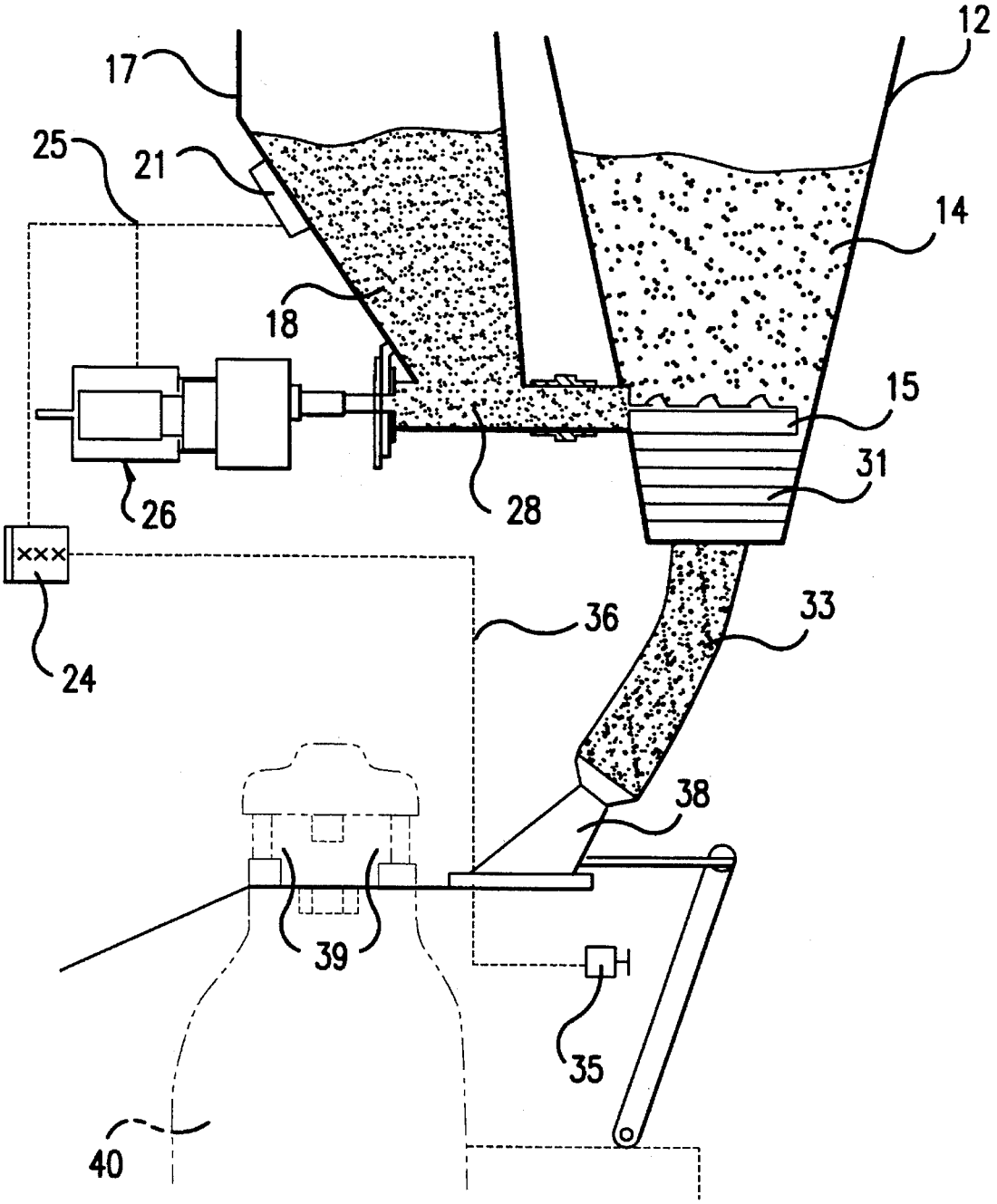
FIG. 1 is a schematic diagram illustrating the the elements involved in the intermixing and molding of a mixture of a first finely divided dry material that is introduced in and admixed with a mass of a second finely divided dry material.

Referring to FIG. 1 of the drawing which serves to illustrate schematically the several elements of a processing operation for combining in the dry form two finely divided materials the mixture of which is introduced into a molding press and formed into a shape suitable for marketing. As seen in FIG. 1, a first powdered material 14 contained in a hopper 12 is disposed for feeding to a common zone 15 with a powdered material 18 that is fed from a contiguously positioned hopper 17. To afford more specificity to the description of the invention, the intermixing is described in connection with the blending into a powdered chlorine composition, a dry powdered lubricant, the resulting mixture of which is to be fed to a press which will shape the powdered material into tablet form. When the invention is thus applied, the powdered chlorine composition is a commercially available product obtainable from a variety of sources such as the the Occidental Chemical Corporation. Powdered lubricants, such as a boric acid powder, are also commercially available materials and may be obtained, for example, from the U.S. Borax company. The prepared mixture comprising the chlorine/lubricant composition which has been formed into the desired shape has a substantial usage in the swimming pool industry.

The invention resides essentially in a means to facilitate the preparation for molding of the dry mixture that is to be fed to the shaping press. As a prerequisite to a practical conditioning of the dry mixture to be fed to the tablet forming press, it is necessary to introduce a lubricant 18 contained in the hopper 17 within the powdered chlorine 14 contained in the hopper 12. As shown in FIG. 1, the invention comprises a system for concurrently feeding and blending the two dry materials, i.e., the powdered chlorine 14 and the lubricant 18 which meet at the zone 15 and are subsequently homogeneously blended in the zone 31. To feed the lubricant 18 into the chlorine 14, suitable means are provided at 28 which comprises an appropriate arrangement for forcibly introducing the additive material 18 into the mass of the material to be conditioned. Suitable means include, for example, an auger feed or a pneumatic feed nozzle which forces the powdered lubricant, or other dry powdered material that is to be intermixed, into a mass of the first finely divided material 14.

The means for feeding a stream of the lubricant may comprise any of several known suitable conveying arrangements such as an auger, described in greater detail with reference to FIG. 2 or a pneumatic means described in more detail with reference to FIG. 3. It will be understood that in addition to the mechanical auger or the pneumatic means, other mechanisms that are effective to introduce a first dry finely divided material into a mass of a second dry finely divided material, may be used to continuously feed a first finely divided dry material into a mass of the second material. To minimize the formation of air pockets in the supply of the powered material and to promote a continuous flow of the powder, a vibrator 21 secured to the exterior of the hopper 17 may be employed. Although the chlorine is more free flowing than the lubricant, a similar vibrator (not shown) may be affixed to the exterior of the hopper 12.

Employing suitable motors and controls, the feeding of the respective powered materials to be blended and formed into tablets is initiated by the material demand from a feed shoe which carries the finely divided mixture into the press to form the tablets.

As illustrated in FIG. 1, upon the starting of the press, feed shoe 38 with the material to be tableted moves into the press zone 39 of the press 40. This movement trips the switch 35 which in turn activates a timer 24 is which starts the motor 26. The motor 26 provides the means, shown schematically at 28 of FIG. 1, for injecting the finely divided additive, lubricant 18, from hopper 17 into the chlorine 14, preferably at a location below the neck 15, into mixing zone 31. When the tablet forming feed shoe 38 of the press 40 is actuated, the chlorine is drawn through the hopper neck 15 which is maintained full at all times during the operation of the press and into the mixing zone 31 where it is contacted by the additive forcibly introduced by the injection means 28 into the zone 31. In the functioning sequence of the system of the invention, when a forward movement of the shoe 38 carrying powdered material to the press forming location occurs, the press switch 35 is a actuated. Switch 35, when activated, triggers a timer 24 which starts the additive material injection motor 26, the timer 24 is preset so that the additive feed motor 26 operates, i.e., feeds, only for the preset period of time which is predetermined and set to supply the required proportion of material to the forming shoe, such amounts being consistent with the tablet size to be produced. An important aspect of the system of the invention resides in the synchronization of the feed by motor 26 with the supply of material called for and carried by the feed shoe 38. In other words, unless the feed shoe calls for material, the motor 26 does not inject material through the additive transmission conduit 28 into the mixing zone 31, This restriction on the motor 26 precludes the feed of additional material when the feed shoe in not calling for, i.e., not consuming, material and is in effect a safeguard against an overfeed of material into the mixing apparatus. Unless the feed of material into the apparatus by the motor 26 is stopped when the material is not being used at the press 40, the material would impact and bind and foul the system causing a substantial clean up problem.

The lubricant injection means as noted hereinabove may include an auger illustrated at 44 of FIG. 2 which extends into the mass of the chlorine or it may comprise a pneumatic injector which extends into the zone 31 as described by reference to FIG. 3 and propels the powdered lubricant into the interior of the chlorine supply.

Figure 2:
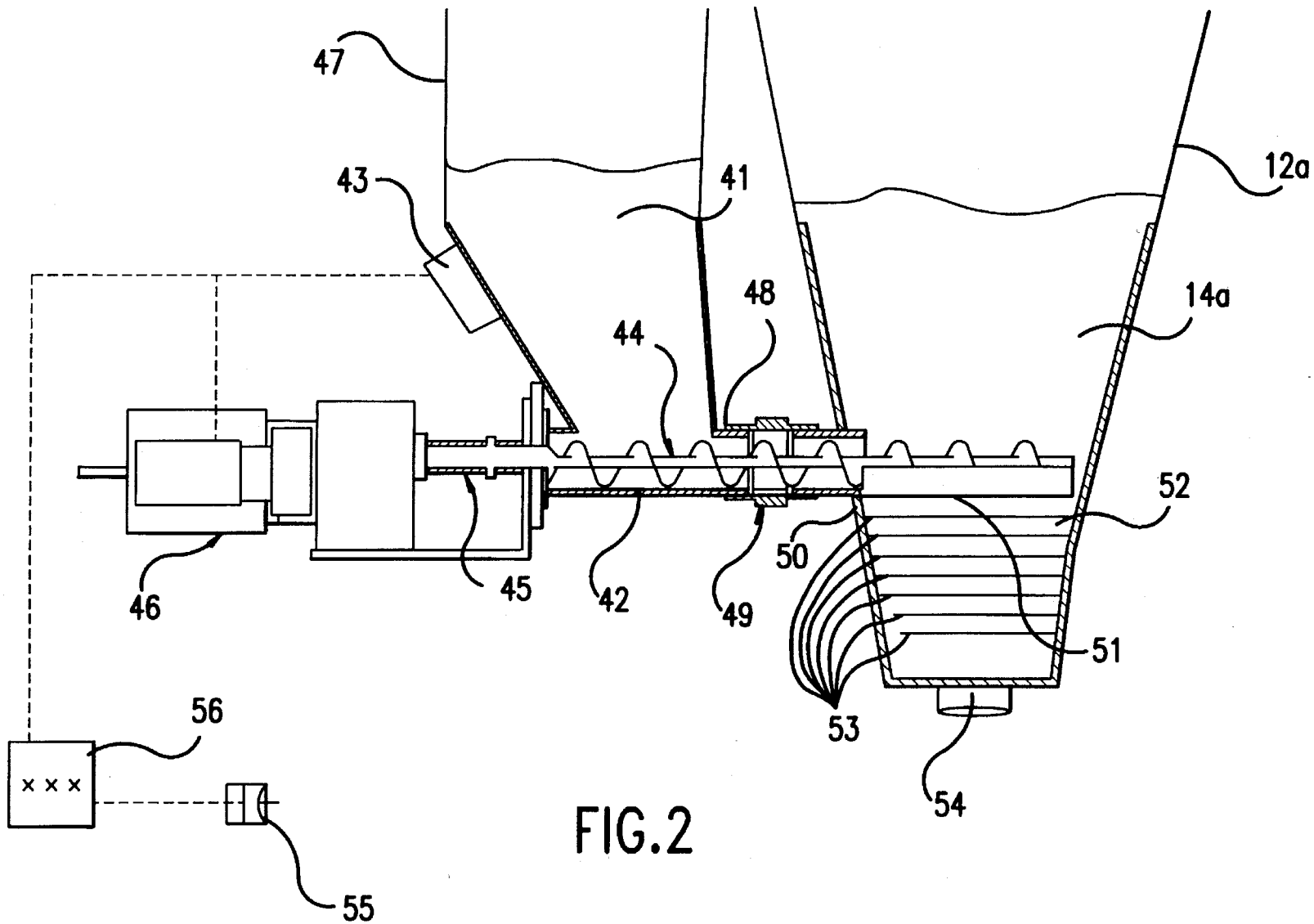
FIG. 2 is an elevational diagrammatic view partially in cross section of an auger means for the introduction of first finely divided dry material, such as a powdered lubricant, into the interior mass of a body of a second finely divided dry material.
Figure 2A:
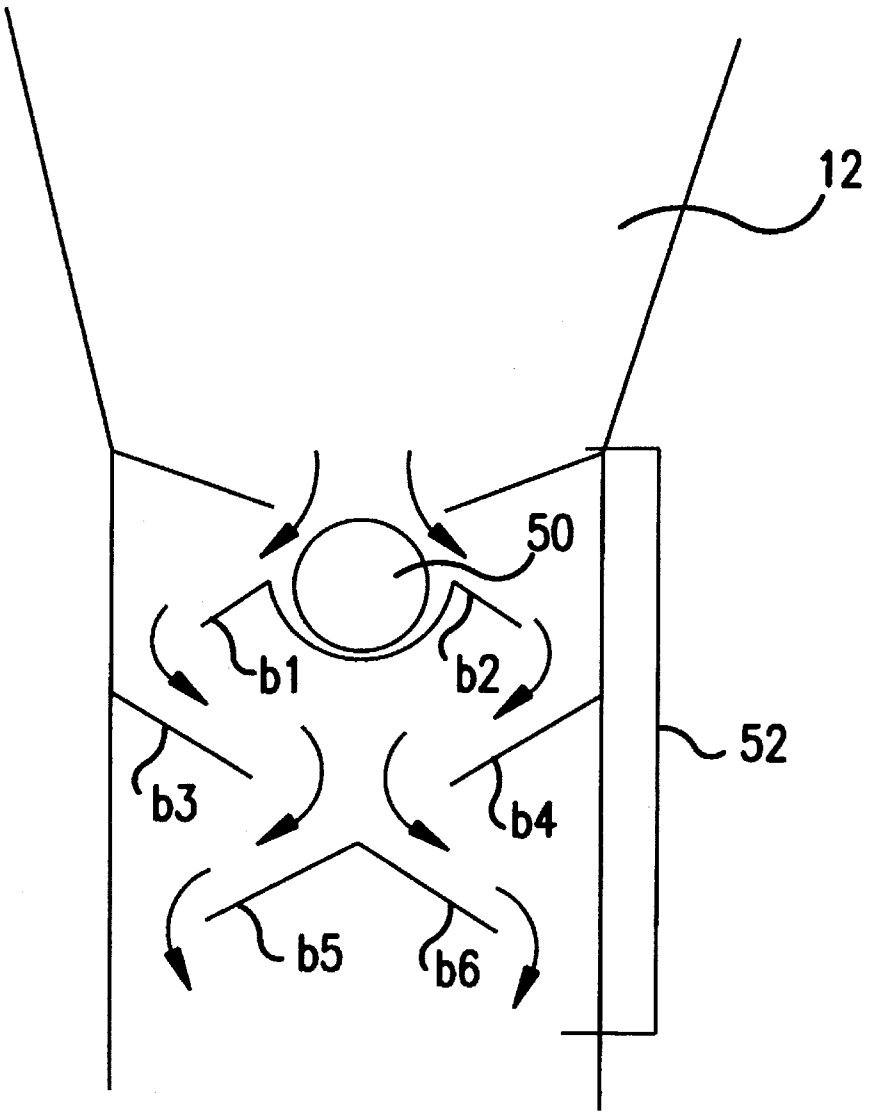
FIG. 2*a* is a schematic illustration depicting one form of an arrangement that provides a tortuous path through which the dry mixture of materials is processed to promote a homogeneous blending of the mixture.

Referring to FIG. 2, a preferred embodiment of the invention, comprising an arrangement whereby a first dry powered material, which may be an additive, is introduced for mixing into a second dry powered material by means of an auger, is illustrated. As shown in FIG. 2, upon activation of a start switch (not shown) of a kind described hereinabove in connection with FIG. 1, the dry additive, e.g., a lubricant 41, from supply container 47 is fed by gravity into the auger bed 42 preferably aided by vibrator 43. The vibrator 43 is mounted on hopper 47 functions to prevent the likelihood of an interruption in flow of the powered, finely divided lubricant, thereby insuring that a full column of lubricant flows to the auger bed 42. The lubricant 41 is transported horizontally by the auger 44. Auger 44 is coupled at 45 and driven by gear motor 46. The gear motor 46 is controlled by a feed switch 55 and sustained by a timer 56. The lubricant 41 is pushed into the engaging tube 48 where it cresses an access union 49. The union or connector 49 functions as an access point and facilitates the servicing of the unit. Once the additive material 41 that is being conveyed by the auger 44 has advanced beyond the point of the union 49, it is forced through a port or opening 50 into a feed bed 51 by the auger 44. In the feed bed 51, chlorine powder **14*a* from hopper 12*a* and the additive 41 from hopper 47 are commingled, and as the two powders pass through a mixing chamber 52, the mixture is homogeneously blended. The mixing chamber 52, one form of which is illustrated in FIG. 2*a* may include a suitable system of baffles 53 that comprises path directing elements, i.e., baffles b1, b2, b3, b4, b5, and b6 and which may also include rotating vanes (not shown), to promote mixing. In the mixing action in chamber 52, the respective dry powders that are to comprise the desired blend, are forced to intermix as they are rolled against each other due to the several obstructing, i.e., path channeling system 53. After a suitable mixing cycle, the blended mixture of the two dry powders exits the mixing chamber 52 and proceeds primarily by gravity into a feed tube 54 (analogous to that described at 33 in FIG. 1**) which transfers the blended mixture to a press (not shown) where the mixture is formed into the desired tablets.

Referring to the alternative embodiment of FIG. 3, an arrangement is illustrated in which the introduction of the finely divided lubricant into the dry powered material to be processed is effected by a pneumatic means as distinguished from the mechanical auger described by reference to FIG. 2.

Figure 3:
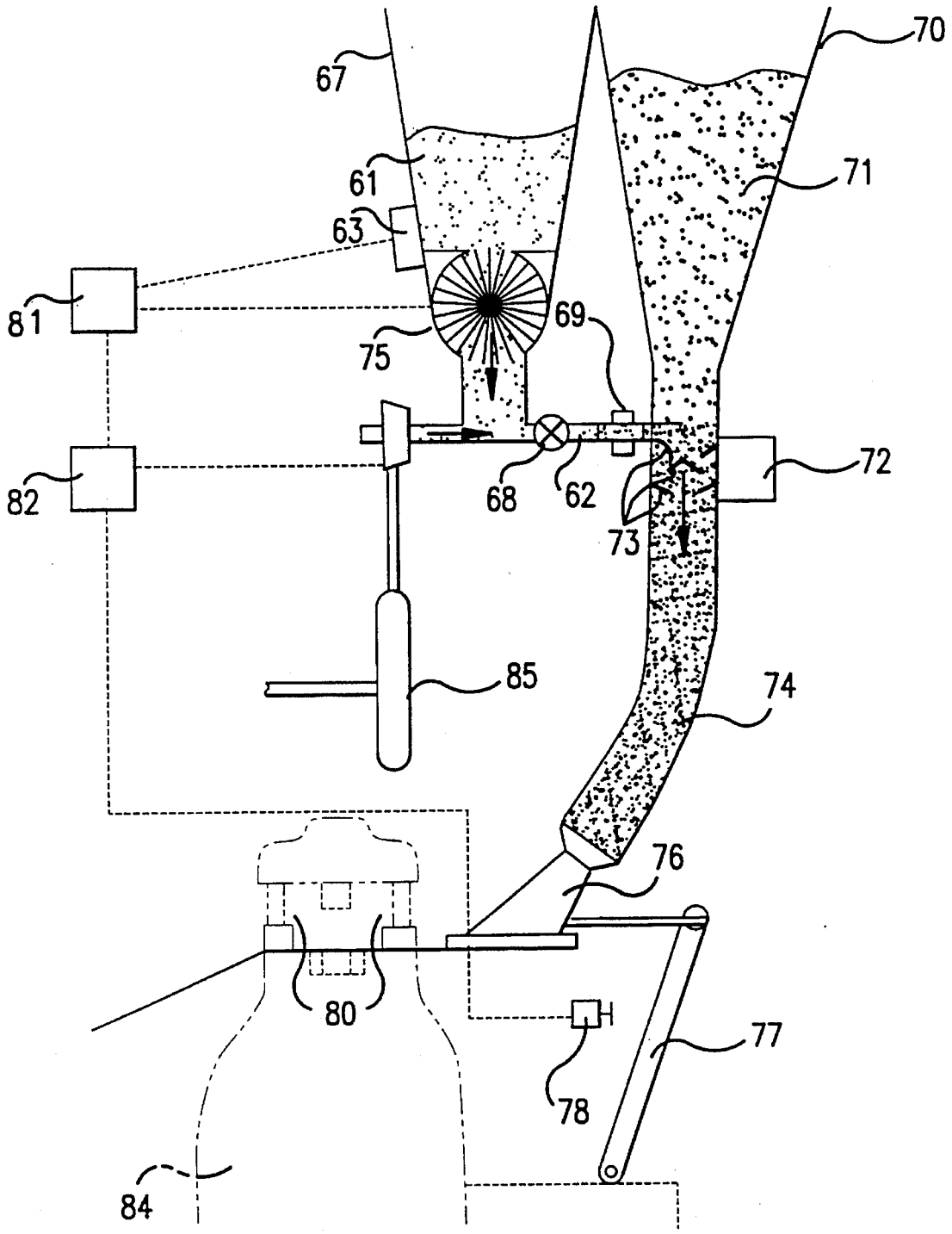
FIG. 3 is an elevational diagrammatic view of an alternative, pneumatic, means for injection of a first finely divided dry material, such as a powdered lubricant, into the interior mass of a body of a second finely divided dry material.

In FIG. 3, the additive 61 in hopper 67 is fed by gravity into a housing containing a feed control device such as through a rotary air lock valve 75 which dispenses the dry additive 61 into the feed passage or conduit 62 of the pneumatic feed of device which by means of compressed air transfers the additive 61 to the mixing zone 70. A vibrator 63 mounted on a hopper 67 aids in the prevention of an interruption and the continuous flow of powder and thereby insures a full column of lubricant to the pneumatic injector compartment. In operation, when the feed shoe 76 is pushed into the zone 80 of the tablet press P, a feed shoe arm 77 trips process switch 78. When switch 78 is activated it initiates timer 81 connected to the vibrator 63 and timer 82 which triggers the flow of the compressed air from source 85. The timer 81 turns on both the vacuum lock valve 75 and the vibrator 63. The valve 75 meters the additive 61 from hopper 67 into the injector tube or passage 62 where the metered amount of additive 61 is pneumatically propelled into the feed bed 70 by the air pressure from the source 85. A suitable dump valve 68 monitored by the timer 82 controls the pneumatic feed. The additive 61, introduced at 70 into the feed bed of material 71, and the material 71 are then more thoroughly commingled in the mixing zones 72 and 73, the latter of which zone preferably contains suitable mixture enhancing baffles. A suitable access union 69 for servicing and maintaining the unit is provided. As the dry powder 61 proceeds past the union 69, it is forced into the feed bed 70 by means of the pneumatic pressure. In the zone 72, the powdered additive 61 and the chlorine powder 71 are mixed. As the two powders pass though the mixing zone 72, the two powders are further intermingled by being tumbled several times due to contacting the baffles or veins 73. As the blended mixture exits the mixing zone 72, the mixture has attained the desired homogeneity. The blended mixture is then directed by gravity through feed tube 74 and proceeds to the tablet press P in a manner described herein by reference to FIGS. 1 and 2.

While the preferred embodiments in which the principles of the present invention have been incorporated is shown and described above, it is to be understood that the invention is not to be limited to the particular details thus presented. A variety of different details may be employed in the practice of the broader aspects of the invention and the scope of the appended claims is intended to encompass such varying details, materials and arrangements of parts of a kind which will be obvious to one skilled in the art upon a reading of the present disclosure.

What is claimed:

1. A method for introducing and dispersing a relatively small quantity of a finely divided dry lubricant material into a mass of finely divided dry chlorine material to provide a substantially homogeneous dry blend of the two materials comprising:

(a) forcibly introducing said lubricant material such that it penetrates into the interior of the mass of the chlorine material, said forcible introduction of lubricant being effected by a means selected from an auger means which carries said lubricant and extends into the interior of the mass of the chlorine and a pneumatic injector means which propels said lubricant into the interior of the mass of the chlorine material;

(b) subsequently commingling the mixture; and thereafter (c) promoting the homogeneous intermixture of the two materials by tumbling the mixture until the desired homogeneity of the mixed lubricant and chlorine material is obtained.

2. The method of claim 1 in which the steps (a), (b) and (c) are conducted in a continuous manner.

3. The method of claim 1 wherein the the homogeneity of the mixed dried materials is obtained by conveying the a mixture by gravity in contact with a fixed baffle arrangement which produces a turbulent movement of the mixture as the mixture is being conveyed.

4. The method of claim 1 wherein the homogeneous intermixture obtained from step (c) is fed to a shaping press and wherein the introduction of material according to step (a) occurs only when material is being fed to the shaping press.

5. The method of claim 1 wherein the introduction of said first material into the second material is effected by an auger which carries said first material and extends into the interior of a mass of the second material.

6. The method of claim 5 wherein the finely divided lubricant material is a boric acid lubricant,

7. The method of claim 1 wherein the introduction of said lubricant material into the chlorine material is effected by a pneumatic injector which propels said lubricant material into the interior of the mass of the chlorine material.

8. The method of claim 7 wherein the finely divided lubricant material is a boric acid lubricant.

* * * * *